United States Patent [19]

Bibber

[11] Patent Number: 4,878,963

[45] Date of Patent: Nov. 7, 1989

[54] CORROSION RESISTANT ALUMINUM COATING COMPOSITION

[75] Inventor: John W. Bibber, Batavia, Ill.

[73] Assignee: Sanchem, Inc., Chicago, Ill.

[21] Appl. No.: 170,169

[22] Filed: Mar. 18, 1988

Related U.S. Application Data

[63] Continuation-in-part of Ser. No. 86,362, Aug. 17, 1987, Pat. No. 4,755,224, which is a continuation-in-part of Ser. No. 908,827, Sep. 18, 1986, Pat. No. 4,711,667.

[51] Int. Cl.[4] ..... C23C 22/66

[52] U.S. Cl. ..... 148/262; 106/14.21; 106/14.12

[58] Field of Search ..... 148/615, 262; 106/14.21, 14.12

[56] References Cited

U.S. PATENT DOCUMENTS 4,755,224 5/1988 Bibber ..... 106/104.21

*Primary Examiner*—Sam Silverberg

*Attorney, Agent, or Firm*—Laff, Whitesel, Conte & Saret

[57] ABSTRACT

An aluminum conversion coating composition for aluminum or an aluminum alloy. The composition has as essential ingredients alkali metal permanganate, and alkali metal chloride, a pH of 7 or over, and a phosphorous compound selected from phosphorous acid and alkali metal phosphate. The composition may also contain a buffer, such as alkali metal tetraborate, alkali metal metaborate, benzoic acid, alkali metal benzoate, alkali metal carbonate and a mixture of the alkali metal tetra-and metaborates. I also provide a permanganate coating process for protecting the 2000 series by cleaning the aluminum alloy and before coating, deoxidizing the aluminum alloy with an acid.

11 Claims, No Drawings

CORROSION RESISTANT ALUMINUM COATING COMPOSITION

This is a continuation-in-part application of my patent application No. 07/086,362 filed Aug. 17, 1987, now U.S. Pat. No. 4,755,224, which was a conlinuation-in-part of my patent application No. 06/908,827 filed Sept. 18, 1986,now U.S. Pat. No. 4,711,667.

The present invention relates to a corrosion resistant coating for aluminum and aluminum alloys and the improved process for coating aluminum alloys having greater than 1.0% Cu with a protective corrosion resistant coating.

BACKGROUND OF THE INVENTION

Generally, aluminum or aluminum alloys are protected by forming thereon an intermediate corrosion resistant conversion coating and then painting over the corrosion resistant coating. Therefore, the corrosion resistant coating must be intimately bonded to the aluminum surface and also provide the required adhesion with the desired final aluminum coating—i.e., paint.

One of the widely used processes for protecting aluminum and aluminum alloys with a corrosion resistant intermediate coating is to coat the surface of the aluminum and aluminum alloys with a protective conversion coating of an acid based hexavalent chromium composition.

Hexavalent chromium has been widely accepted as an intermediate corrosion resistant conversion coating because it protects the aluminum and aluminum alloy surfaces for extended periods of time. The hexavalent chromium provides a corrosion resistant coating which can withstand a salt fog bath for more than 168 hours. The coated aluminum or aluminum alloy is placed in a salt fog at 95of according to ASTM method B-117 for at least 168 hours and then removed. This requirement is necessary for many applications. Further, the hexavalent chromium composition provides an intermediate coating which is receptive to the application and retention of other coatings, such as paints, to the aluminum or aluminum alloy surfaces.

The excellent features, of the hexavalent chromium composition, have made these compositions used extensively for the corrosion resistant protection of aluminum and aluminum alloys and as an intermediate corrosion resistant coating.

However, the hexavalent chromium compositions have a serious side effect. Chromium is highly toxic and the spent chromium compositions provide an ecological problem. Many people in the industry are attempting to eliminate this ecologically damaging waste problem and it is very costly.

Other corrosion resistant compositions have been suggested, but they have not been as successful as the hexavalent chromium compositions.

In 1940 Collari reported for the first time on the inhibiting action of potassium permanganate against attack by sodium hydroxide on aluminum. (*Chemical Abstracts* 5814-6, Volume 34, 1940). In 1941 Lilli Reschke and Heinrick Neunzig (*Chemical Abstracts,* Vol. 36, 1942, 5760-5-7) reported the first study on the inhibiting action of potassium permanganate against the attack by sodium hydroxide on aluminum. Finally, in 1947 (*Chemical Abstracts* 4759 e.g., Vol. 41, 1947) Collari and Fongi also compared the inhibiting action of potassium permanganate to sodium chromate in inhibiting attack by sodium hydroxide on aluminum at various temperatures.

Various compositions of sodium chromate and sodium hydroxide were utilized, and sheets of aluminum were emersed in these solutions. The solutions all had a pH of 12.5 or greater than 12.5.

It was appreciated, after these articles, that the most effective corrosion resistant coatings were those which are acid based. The basic compositions of hexavalent chromium were not effective for prolonged corrosion protection of aluminum surfaces. Neither the basic chromium nor the basic permanganate which have a pH of greater than 12.5, would be appropriate for the corrosion resistant coating of aluminum wherein the aluminum requires a corrosion protection in a salt fog of greater than 168 hours. Further, the industry decided that the basic compositions were inadequate for their purposes because highly basic solutions attacked aluminum surfaces. The industry has concentrated their efforts on acid based conversion coating compositions.

In some applications, the acid chromate composition was combined with potassium permanganate to form a black coating. The pH of the solution stayed in the preferred range of 2–3, U.S. Pat. No. 4,145,234.

Also, it has been suggested, that the use of the oxidizing agents, sodium or potassium chromate and potassium permanganate, may be added to an electrolyte solution to inhibit the corrosion of aluminum electrodes.

In the immersion coating of aluminum with a chromium coating, the thickness of the chromium coating is usually varied by the amount of time the aluminum or aluminum alloy was in contact with the corrosion resistant composition.

U.S. Pat. No. 3,516,877 illustrates coating a 5051 aluminal alloy irrigation pipe with NaOH and $KMnO_4$. The particular alloy used by U.S. Pat. No. 3,516,877 is generally a corrosion resistant alloy and presently is not widely used. The patent does not give any specific indications of the protection provided, but merely states that the pipe withstood corrosion. When I directly compared the composition of the U.S. Patent with my composition, an alloy, my composition had a substantial increase in corrosion resistance.

SUMMARY OF THE INVENTION

My invention eliminates some of the problems of the hexavalent chromium compositions by providing a corrosion resistant coating composition which, if desired, contains no chromium or other similar toxic materials. Also, for those applications which require it, we provide a corrosion resistant coating for aluminum or aluminum alloy surfaces which can withstand a salt fog at 95° F. of according to ASTM Method B-117 for at least 168 hours, and which when desired, will provide an excellent intermediate coating.

Also, we eliminate the need for special handling, which is sometimes required by acid solutions, by providing a basic coating composition which can, if desired, contain no chromium.

Accordingly, this invention is directed to providing a protective coating for aluminum and aluminum alloys, which has as essential ingredients, an alkali metal permanganate, and phosphoric acid as phosphate in a solution having a pH in the range of 7 to less than 12.5.

Another aspect of this invention is to provide a protective coating for aluminum and aluminum alloys, which has as essential ingredients, an alkali metal permanganate, alkali metal phosphate or phosphoric acid and having base pH of 7 or over.

Another aspect of the invention is to provide an improved process for providing corrosion resistant coating for aluminum alloys of the 2000 series.

It is still another object of the present invention to provide an aluminum or aluminum alloy corrosion resistant coating composition which has as essential ingredients, an alkali metal permanganate, an alkali metal chloride salt, alkali metal phosphates or phosphoric acid, and buffer compounds selected from the group consisting of alkali metal tetraborate, alkali metal metaborate, and a mixture of the alkali metal tetra-and metaborates.

The alkali metal permanganate composition may be applied in any acceptable manner (i.e., immersion, spraying, misting or spreading by an appropriate applicator).

The pH of the composition is between 7 and less than 12.5.

The aluminum or aluminum alloy surface is normally immersed in my aqueous alkali metal permanganate solution which contains the essential ingredients. The temperature of the solution is between room temperature and the boiling point of the composition. The preferred temperature is between 60° and 180° F., with the most preferred between 100° and 180° F. However, as the temperature is raised, less immersion time is necessary to form the corrosion resistant coating on the aluminum or aluminum alloy surfaces.

The alkali metal as referred to herein is selected from potassium, sodium or lithium.

The preferred alkali metal permanganate is potassium or sodium permanganate. The concentration of the permanganate, to provide 168 hours of salt fog protection for the aluminum or aluminum alloys, is of a sufficient amount to provide at least 700 ppm of Manganese in the coating solution with the practical maximum being the saturation point of the permanganate. When potassium permanganate is used, a concentration of 0.2% by weight is about 700 ppm manganese. At room temperature, a saturated $KMnO_4$ solution is 6.3% by weight; 32° F. is 2.8% by weight and at 212° F. is 28% by weight. The sodium permanganate is infinitely soluble and, therefore, has no practical upper limit.

The preferred alkali metal chloride is NaCl or LiCl. The concentration of the NaCl or LiCl is generally within the range of 0.05–10% by weight of the solution and preferably within the range of 0.1 to 5% by weight of the solution.

The alkali metal phosphate is preferably $K_2(HPO_4)$. The concentration of $K_2(HPO_4)$ when used is within the rang of 0.1% to 1% by weight of the solution with the preferred being 0.5% by weight of the solution.

The phosphates I use in my composition are the alkali metal phosphates and phosphoric acid. The phosphoric acid is used only in quantities which will not lower the pH to less than 7. If the quantity of phosphoric acid is too great, NaOH can be added to neutralize the acid or change it to sodium phosphate. In any event, the pH of composition is not to fall below 7.

The preferred immersion time for preparing a corrosion inhibiting coating on aluminum or aluminum alloy surfaces, is approximately 30 seconds at 155° F. and approximately one hour at room temperature. A longer immersion time than the predetermined optimum time does not increase the coating thickness to any appreciable amount and, therefore, would not be economically worthwhile.

Other compounds may be added, if desired, providing the compounds do not interfere with the desired corrosion resistant protection of the aluminum or aluminum alloy surfaces.

The cleaning compounds for the aluminum or aluminum alloy surfaces are sodium hydroxide, alkaline solutions of sodium nitrate, hydrofluoric acid, sulfuric acid, nitric acid, sodium carbonate, borax, and a commercial non-ionic surfactant polyoxyethylene or polyoxypropylene derivatives of organic acids, alcohols, alkylphenols or amines, a commercial non-ionic surfactant which I have used is a polyoxyethylene derivative or organic acids such as "Triton X-100" sold by Rohn and Haas Corp., which is less dangerous to use than sodium hydroxide or hydrofluoric acid.

It is also recommended that neither the cleaning composition nor the corrosion resistant alkali metal permanganate composition contain a fatty acid, or any compound which would interfere with adhesion or formation of a protective coating on the aluminum or aluminum alloy surface.

In my application 07/086,362 I provide a method for protecting 2024 aluminum. However, although I was able to repeat this method and obtain excellent results for some panels, I was not able to consistently obtain those results.

My new process, however, has given me consistent results. In my new process, after I degrease and clean the panels and then rinse in D.I. water, I treat the panels with an acid solution—i.e., a mixture of sulfuric acid and nitric acid to remove metal oxides from the panel. In my preferred process, I perform a second deoxidation step by further treating the panel in another acid solution—i.e., nitric acid. Then I follow the procedure I previously used for 2024 aluminum.

The following examples 1 to 4 illustrate for comparative purposes the use of a composition of potassium permanganate and sodium hydroxide for coating aluminum. These examples show that NaOH composition does not provide the corrosion resistance for aluminum that is provided by my composition and process. In all of the following examples, all percentages are percentages by weight, unless otherwise indicated. In the following examples 1–6, an aluminum alloy panel is used which is made from the aluminum alloy (Alloy No. 3003 H14) purchased from Q-Panel Company of Cleveland, Ohio. It is understood that this alloy has more than 95% by weight of Aluminum and has on average a composition of by weight 96.4–96.75% Al, 0.6% Si, 0.7% Fe, 0.5% Cu, 1.2% Mn, 0.1% Zn and 0.15–0.5% maximum other elements as impurities.

EXAMPLE 1

(a) The aluminum alloy panel was degreased with mineral spirits and cleaned in a 0.1% sodium hydroxide solution for one minute at room temperature. The panel was rinsed and then immersed in a room temperature solution of 1% potassium permanganate, and 0.1% sodium hydroxide with the remainder being water. The aluminum panel was exposed for approximately 1 minute.

(b–d) The above procedure was repeated with solutions containing 0.5%, 1% and 2% sodium hydroxide.

In all of the above cases the panel was removed from the potassium permanganate-sodium hydroxide solution, rinsed with water, and then wiped. With the exception of the 1.0% and 2.0% sodium hydroxide solution, which left no film, a very thin tan coating remained. When placed in a salt fog at 95° F. according to ASTM method B-117, pitting began after a few hours of exposure.

EXAMPLE 2

The procedure of Example 1 was repeated with each of the solutions except the exposure time for each of the solutions was increased to one hour. A much thicker coating appeared on all of the aluminum panels. The coating did not completely wipe off. The panels were dried and placed in a salt fog at 95° F. according to standard ASTM method B-117. All the panels showed noticeable pitting after a few hours. The pitting was more extensive with the 2.0% solution than the 0.1% NaOH solution. Also, the panels subjected to the 1% and 2% NaOH solutions showed a substantial loss of aluminum from the panel.

EXAMPLE 3

The procedure of Example 1 was followed for each of the solutions except the temperature of each of the coating solutions were raised to and maintained at 155° F.

When the panels were removed after 1 minute of immersion, it was noted that there was considerable loss of aluminum metal especially with the 0.5%, 1% and 2% NaOH solutions and considerable pitting after being subjected to a few hours of salt fog at 95.F, ASTM method B-117. The loss of aluminum was greater as the concentration of the NaOH increased.

EXAMPLE 4

The procedure of Example 3 was followed for each of the solutions with each coating solution maintained at a temperature of 155° F. and the immersion time increased to 15 minutes.

When the panels were removed from the 0.5% and 1% NaOH solutions, they were rinsed, dried and subjected to an eight hour salt fog at 95° F. of ASTM method B-117. Considerable pitting was noted on each panel and more aluminum metal was lost than in Example 3. At 2% of NaOH, the aluminum metal strip used was entirely dissolved.

The loss of aluminum metal and the relatively short protection time is a serious drawback to the use of a sodium hydroxide-potassium permanganate composition. It is further noted, that the pH of all of the above solutions was 12.5 or greater.

The following examples illustrate the compositions and process of our invention. The examples are for illustrative purposes and are not intended to limit the invention to the specifics of each example. Aluminum alloy of the same composition used in Examples 1–4 is used.

EXAMPLE 5

An aluminum panel of "3003" alloy was degreased in mineral spirits, cleaned to a break-free surface with a commercial non-ionic cleaner, such as "Triton X-100" from Rohm and Haas Corp., and etched in a 5% sodium hydroxide solution for 30 seconds. The panel was then immersed for 30 seconds at 155° F. in a solution consisting of:

3.0% Potassium Permanganate ($KMNO_4$)
1.0% Phosphoric Acid ($H3PO_4$)-85%
0.4% Sodium Hydroxide (NAOH)
1.0% Lithium Chloride (Licl)
94.6% Water and having a pH of about 7.0. The panel was rinsed off with water, dried and placed in a salt-fog for 24 hours according to ASTM standard B117. The panels showed no darkening from its original bright silver appearance.

EXAMPLE 6

An aluminum panel of "3003" alloy, treated in the same manner as in Example 1, showed no darkening in color when placed in boiling distilled water for 15 minutes.

EXAMPLE 7

An aluminum alloy panel of "6063" alloy which has an average a composition of:

0.4% silicon
0.7% magnesium and,
98.9% aluminum was degreased with mineral spirits and cleaned to a break-free surface with Triton X100.

The panel was then immersed in D.I. water, containing less than 1.0 PPM total impurities, at 200° F.–212° F. for 5 minutes. This formed a thin film of boehmite on the surface of the metal. Further treatment of the panel for two minutes at 175°–180° F. in a solution of:

3.0% Potassium Permanganate ($KMNO_4$)
1.0% Dipotassium Phosphate ($K_2HPO_4$)
1.0% Sodium Chloride (NaCl)
0.1% Borax ($Na_2B_4O_7.5H_2O$)
94.9% water gave a clean metallic finish to the metal. After rinsing and drying the panel was placed in a salt-fog at 95° F. according to ASTM method B-117 for 168 hours. The panel showed no pits in the treated area.

EXAMPLE 8

An aluminum alloy panel of "2024" alloy (has an average a composition of: 4.4% Cu, 0.6% Mn, 1.5% Mg and 93.5% Al) was degreased with mineral spirits and cleaned to a break-free surface with Triton X-100. After rinsing with D.I. water, the panel was immersed for five minutes in a solution of 15% sulfuric acid ($H_2SO_4$) and Il 10% nitric acid ($HNO_3$ 70%) at 165°–170° F. to remove metal oxides. The panel was further deoxidized in 70% nitric acid for one minute. After another rinse in D.I. water the panel was placed in D.I. water containing less than 1 0 PPM total impurities, at 200° F.–212° F. for five minutes to form a thin film of boehmite (A10 . . . OH) on the metal surface. Further treatment of the panel at 180° F. for two minutes, in a solution of:

3.0% Potassium Permanganate ($KMnO_4$)
2.0% Lithium Chloride (LiCl)
1.0% Lithium Nitrate ($LiNO_3$)
0.5% Sodium Silioate Pentahydrate ($Na_2SiO_3.5H_2O$)
93.5% Water gave a clean metallic finish to the metal. After rinsing with D.I. water t.he panel was placed in an aqueous saturated lime ($Ca(OH)_2$) solution containing 1.0% lithium nitrate at 180° F. for two minutes. After rinsing again in D.I. water the panel was placed in an aqueous solution of Potassium silicate (0.83% $K_2O$ and 2.1% $SiO_2$) at 180° F. for two minutes, rinsed again in D.I. water, dried and placed in a salt-fog at 95° F. according to ASTM standard B117 for 336 hours of exposure. The panel showed no signs of pitting.

Our examples show a substantial improvement over a potassium permanganate - sodium hydroxide composition and over the use of chromate compositions. Our compositions do not have the toxicity of the chromates and are therefore more environmentally effective.

I claim:

1. An alkali metal permanganate coating composition for aluminum and aluminum alloys comprising a basic pH and having as the essential ingredients thereof n alkali metal permanganate, an alkali metal chloride and a phosphorous compound selected from the group consisting of alkali metal phosphate and phosphoric acid.

2. The composition of claim 1 wherein the permanganate is potassium permanganate and the chloride is sodium chloride and/or lithium chloride.

3. The composition of claim 2 which includes a borate compound selected, from the group consisting of an alkali metal tetraborate, alkali metal metaborate, a mixture of the alkali metal tetra and metaborate, and the hydrated alkali metal meta and/or tetraborate.

4. The composition of claim 3 wherein one of the essential ingredients is borax.

5. The composition of claim 1 which includes an alkali metal phosphate and lithium chloride.

6. The composition of claim 2 wherein the phosphate is phosphoric acid, t.he chloride is lithium chloride.

7. The composition of claim 3 wherein the phosphate is dipotassium hydrogen phosphate, the borate compound is borax.

8. The composition of claim 7 wherein the chloride is sodium chloride.

9. The composition of claim 1 which is an aqueous permanganate solution having a pH in the range of 7 to 12.5.

10. The composition of claim 6 which contains:

1.0% by weight LiCl, and
3.0% by weight $KMnO_4$,
1.0% by weight $H_3PO_4$ (85%)
0.4% by weight NaOH.

11. The composition of claim 7 which contains:

0.1% by weight borax
3.0% by weight $KMnO_4$
1.0% by weight $K_2HPO_4$.

* * * * *